US006718724B2

(12) United States Patent
Thomas

(10) Patent No.: US 6,718,724 B2
(45) Date of Patent: Apr. 13, 2004

(54) TRUSS INSERT TRACK SYSTEM

(76) Inventor: James L. Thomas, 2007 Victoria Rd., Mendota Heights, MN (US) 55125

( * ) Notice: Subject to any disclaimer, the term of this patent is extended or adjusted under 35 U.S.C. 154(b) by 0 days.

(21) Appl. No.: 09/817,401

(22) Filed: Jul. 13, 2001

(65) Prior Publication Data

US 2003/0009983 A1 Jan. 16, 2003

(51) Int. Cl.[7] ..... E04G 21/14
(52) U.S. Cl. ..... 52/749.1
(58) Field of Search ..... 52/126.1, 365, 52/749.1, 702, 715, 712, 655.1

(56) References Cited

U.S. PATENT DOCUMENTS 3,907,445 A * 9/1975 Wendt ..... 403/191
3,945,741 A * 3/1976 Wendt ..... 403/191
4,124,962 A * 11/1978 Lancelot et al. ..... 403/232.1
4,158,940 A * 6/1979 Lancelot et al. ..... 403/232.1
4,411,548 A * 10/1983 Tschan ..... 403/232.1
4,753,014 A * 6/1988 Vrajich ..... 269/909
4,893,961 A * 1/1990 O'Sullivan et al. ..... 403/187
4,947,616 A * 8/1990 Sorton ..... 33/613
5,054,755 A * 10/1991 Hawkes ..... 269/239
5,111,632 A * 5/1992 Turner ..... 403/232.1
5,312,095 A * 5/1994 Rennie ..... 269/41
5,383,320 A * 1/1995 Sorton ..... 33/645
5,564,248 A * 10/1996 Callies ..... 403/232.1
5,836,131 A * 11/1998 Viola et al. ..... 52/702
6,126,156 A * 10/2000 Brodeur ..... 269/3
6,272,951 B1 * 8/2001 Lambson ..... 269/3
6,301,855 B1 * 10/2001 Aerni ..... 403/232.1

* cited by examiner

*Primary Examiner*—Leslie A. Braun
*Assistant Examiner*—A. Joseph Wujciak, III
(74) *Attorney, Agent, or Firm*—Jacobson & Johnson

(57) ABSTRACT

A construction tool having a reference end with a hanger holder positioned a builders unit from the reference end to enable the construction tool to be used as a marking guide or to carry a joist hanger to enable a user to accurately and quickly position and secure a joist hanger on a cross member.

15 Claims, 2 Drawing Sheets

TRUSS INSERT TRACK SYSTEM

FIELD OF THE INVENTION

This invention relates to construction tools and more specifically to a tool for quickly and accurately positioning joist hangers.

BACKGROUND OF THE INVENTION

The concept of hangers such as joist hangers is known in the art. Typically, a joist hanger is fastened to a header to support the end of a joist. Use of joist hangers eliminates the need for toe nailing the end of a joist which is positioned at a right angle to a header. One of the difficulties with using joist hangers is that each of the joist hangers must be precisely positioned on the header in order to maintain the proper joist spacing for receiving precut construction sheets. While it is time consuming to layout the location of each joist hanger there is also the problem of accidentally mismarking the location if the joist hangers are positioned across an extended span. The present invention provides a construction tool, which I refer to a "truss insert track system" that enables one to quickly and accurately locate and secure a plurality of joist hangers along a header.

SUMMARY OF THE INVENTION

Briefly, the invention comprises a construction tool having a reference end with a location hanger holders such as a notch spaced a "builders unit" from a reference or abutment end of the construction tool to enable the notch to be used either as a marking guide or to carry a joist hanger. In one mode it enables a user to accurately and quickly position a location mark on a header and in another mode it enables a user to accurately and quickly position a plurality of joist hangers on a cross member.

DESCRIPTION OF THE PREFERRED EMBODIMENT

Figure 1:
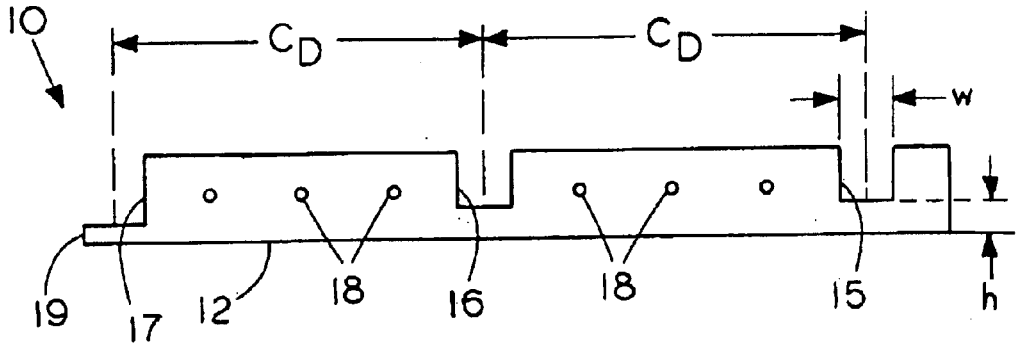
FIG. 1 is a front view of the construction tool for marking and positioning.

FIG. 1 is a front view of the construction tool 10 for marking or positioning a hanger. Tool 10 comprises a one-piece rigid elongated member having a first element 11 and a second element 12 positioned at a right angle with respect to each other. These structures are often referred to as angle irons but can be made of materials besides iron.

Tool 10 incudes an abutment end 17 for locating the construction tool 10 with respect to a reference position.

Spaced from abutment or reference end 17 is a first hanger holder comprising a first U-shaped reference notch 16 and a second hanger holder comprising a second U-shaped reference notch 15. The reference notches are spaced a distance $C_d$ from each other which is hereinafter referred as a "builders unit". By "builders unit" it is meant a spacing commonly used to position studs, joists, rafters or the like so that sheeting or the like can be secured thereto so the junction between adjacent sheeting materials falls midway on a joist, rafter or stud. Presently, two lengths of builders units, namely, 12 inches and 16 inches are in wide use although it is envisioned that "builders units" of other dimension can be used with the present invention.

The first notch 16 extends partway into front element 11 and is positioned a distance "h" above the lower element 12. Similarly, the second notch extends partway into front element 11 and is positioned a distance "h" above the lower element 12. In the embodiment shown a lip 19 extends outward from abutment end 17 with lip 19 also positioned a distance "h" from the bottom of tool 10. Thus the notches 16 and 15 provide for location in two mutually perpendicular axis.

Figure 2:
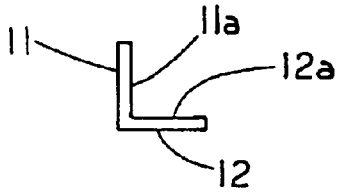
FIG. 2 is an end view of the construction tool of FIG. 1.

FIG. 2 is an end view of the construction tool 10 showing the element 11 and element 12 positioned at a right angle to one another. It is envisioned that construction tool 10 can be made from metal such as aluminum or some other rigid but lightweight material. Element 11 has an inside face 11*a* and element 12 has an inside face 12*a* with element face 11*a* and 12*a* located at a right angle to each other. Having element face 11*a* and element face 12*a* at right angles to one another allows one to snugly press construction tool 10 against a corner of a member such as a header. Thus the corner of the header becomes a location edge and the distance "h" becomes a reference distance for the bottom of the hanger from the location edge.

Figure 3:
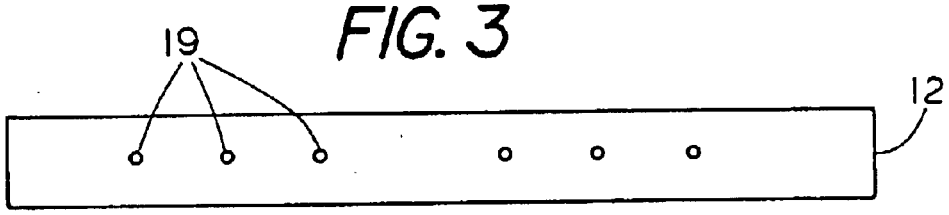
FIG. 3 is a bottom view of the construction tool of FIG. 1.

FIG. 3 is a bottom view of the construction tool 10 showing a plurality of spaced holes which provide regions for securing fasteners therethrough to hold the construction tool 10 in temporary position on a member such as a header. A similar set of holes 18 are located in element 12 to provide an alternate region for temporarily securing of the construction tool 10 to a member. The holes 18 are shown as round for insertion of a fastener such as a screw fastener or nail therein. In order to hold construction tool 10 in position while the hangers are being secured one can use a fastener wherein the head is larger than the openings 18 so that the fastener secures the construction tool 10 to the header member. Once the hangers are secured in position the fastener can be removed.

As an alternate method of temporarily securing construction tool 10 one can use headless nails such as finishing nails to hold the construction tool in vertical position on the header member. Once the hangers 20 and 30 are fastened, the construction tool 10 can be removed by pulling the construction tool outward allowing the openings 18 to slide past the headless nails. If desired, the headless nails could be removed; however, since headers are generally on interior surfaces the nails can be left in position or, if desired, one could simply drive the headless nails into the header.

Figure 4:
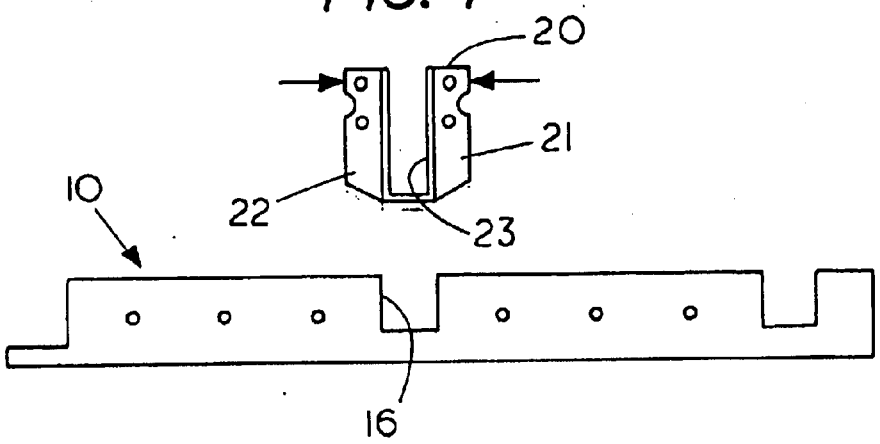
FIG. 4 is front view of a joist hanger positioned for insertion into a notch on the construction tool of FIG. 1.

FIGS. 4 through 7 illustrate the method of hanging joist hangers comprising the steps of positioning a first joist hanger 20 in frictional engagement in a notch 16 of a construction tool 10. Hanger 20, which is known in the art, generally includes a nailing flange 21 on one side and a nailing flange 22 on the opposite sides. FIG. 4 illustrates by arrows that the hanger 20, which is generally made of sheet metal can be squeezed together to facility insertion of the joist hanger in notch 16. In order to provide frictional engagement between the hanger 20 and notch 16 the hanger 20 has a first width and the notch has a second width with the second width of the notch 16 sufficiently small so as to from a frictional fit with the outside surfaces of hanger 20.

Figure 5:
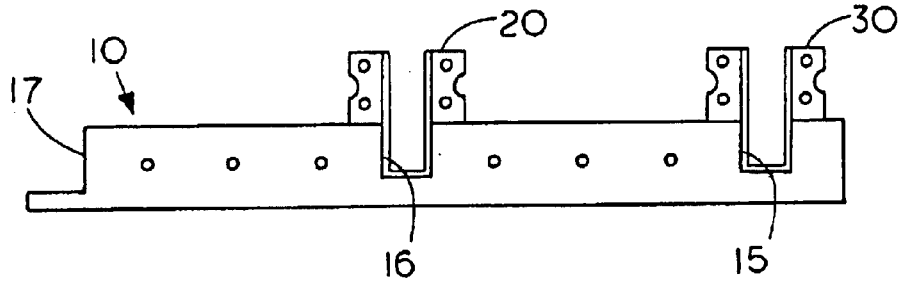
FIG. 5 is a front view of the construction tool of FIG. 1 with two joist hangers frictionally held therein.

FIG. 5 shows the construction tool 10 with a first hanger 20 and a second hanger 30 that are frictionally held a spaced distance from an abutment end 17 with each of hangers end located a builders unit multiple from the abutment end. By having the hangers frictionally held in construction tool 10 it allows the user to handle and position the construction tool without concern that the hangers will fall out of the construction tool. In addition, by employing a friction fit one can quickly remove the construction tool from the joist hangers by overcoming the frictional forces between the hangers and the construction tool. 10.

Figure 6:
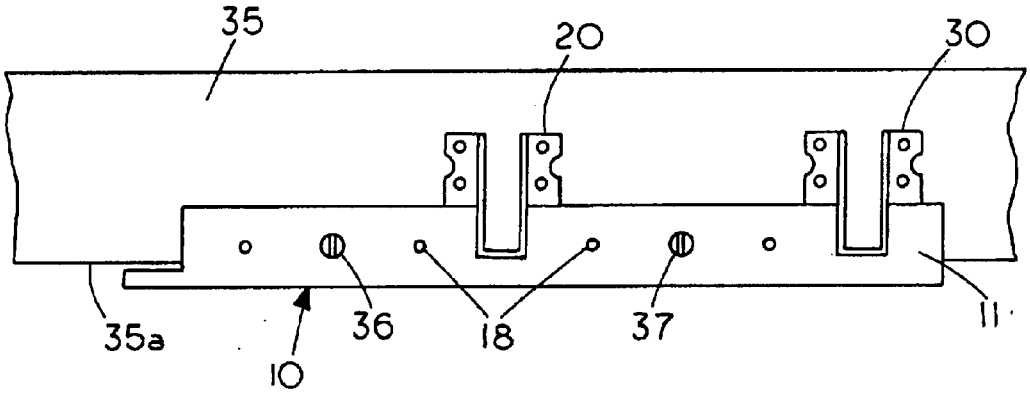
FIG. 6 is a front view of the construction tool and joist hangers of FIG. 5 temporarily secured to a cross member.

FIG. 6 illustrates the next step of temporarily securing the construction tool 10 with the joist hangers 20 and 30 to a member such as header 35. If the header is made of wood or sheet metal, screw fasteners such as screws 36 and 37 can be secured through openings 18 in element 11 and into header 35 to temporarily hold the construction tool 10 in the position shown in FIG. 6. In this condition the element faces 11*a* and 12*a* are positioned on opposed sides of corner 35*a* of header 35 with the corner edge 35*a* of the header 35 forming a reference for positioning the construction tool 10.

In the next step, one secures the joist hangers 20 and 30 to the member 35 with suitable fasteners. In the embodiment shown, nails 20*a* which extend through the nailing flange 20, secure joist hanger 20 to member 35 and nails 30*a*, which extend through the nailing flange 30, secure joist hanger 30 to member 35.

Figure 7:
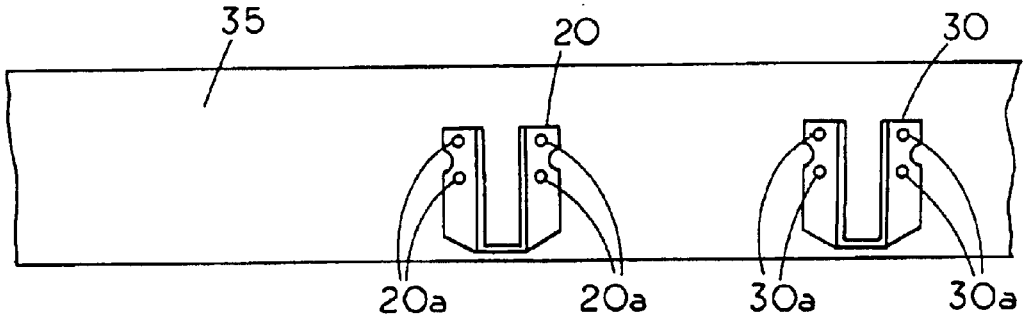
FIG. 7 shows the joist hangers of FIG. 5 secured to the cross member after removal of the construction tool.

In the next step, one removes the construction tool 10 to leave the joist hangers 20 and 30 secured to the member 35 as illustrated in FIG. 7. Thus, through the lateral positioning of the construction tool 10 on the edge of the header one is able to precisely position and secure the joist hangers without having to make a separate measurement. By the axial positioning of the abutment end 17 against a reference mark such as another joist hanger or another joist one can automatically provide for proper spacing between adjacent joist hangers.

An alternate use of construction tool 10 is as a tool to layout stud positions and visually mark the position on a header. In the alternate method, one places construction tool 10 having a reference end 17 and a plurality of refernce guides such as notches 16 and 15 each located a builders unit from each other on a member. If desired the construction tool is held in position by a hand of a user. Next, one takes a visual marker such as a pencil and marks the outline of the U-shaped notches 16 and 17 on the member. Once marked one can remove the construction tool 10 to provide visual markings each spaced a builders unit from each other. Once a first set of markings are made one can repositioning the constriction tool by placing the reference end 17 in abutment with the visual marking on the member and mark new stud positions by again following the outline of the notches 16 and 17 on the member with a visual marker. While notches are used as reference guides it should be understood that other guides such as pointers or protrusions could also be used as reference guides.

It should be pointed out that while a construction tool with positions for two hangers is shown more or less hanger holders could be used. In addition, although notches are shown for holding the hanger in position it is envisioned that other hanger holders for temporarily securing the hangers to the construction tool are within the spirit and scope of the present invention. For example, a magnetic holder or a hanger holder with a member that can engage and hold the hanger in a fixed but temporary position on construction tool 10. In addition, element 11 could be of lesser height so that the hanger holder would protrude upward therefrom and not necessary appear as a notch in the element.

Figure 8:
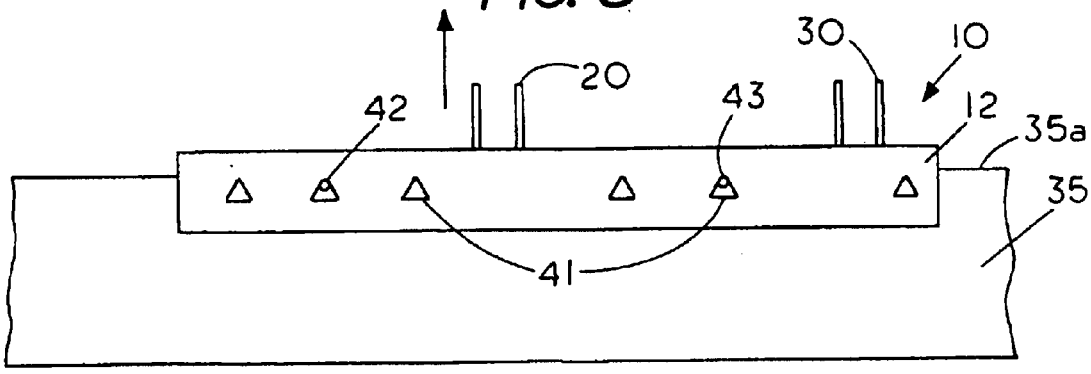
FIG. 8 shows a bottom view of construction tool having fastening regions with diverging slots.

FIG. 8 shows an alternate method of securing the construction tool 10 to the underside of a header 35. In this embodiment generally triangular shaped holes 41, which have a wider base positioned toward the side away from where the joist hangers are secured are used to support construction tool 10. By positioning tool 10 against corner 35*a* the user then inserts the fastener having a head at the apex of the triangular shaped hole. Once secured to the header the fastener holds the construction tool 10 in position. After the joist hangers 20 and 30 are secured to header 35 the user merely slides construction tool in the direction shown by the arrow which causes the fasteners 42 and 43 to be positioned in the wider base region of the holes 41. As a result the construction tool can be removed by slightly tipping the construction tool 10 until the construction tool element 12 clears the head of fasteners 42 and 43. One can then pull the construction tool 10 free of the header 35.

I claim:

1. A construction tool comprising:

a rigid elongated member, said rigid elongated member including a joist hanger, said rigid elongated member having an abutment end for locating the construction tool with respect to a reference position, a first hanger holder carried by said elongated member, said hanger holder comprising a notch extending partway into the elongated member and said joist hanger is frictional held in the notch of said elongated member, said hanger holder spaced from the abutment end so that when the construction tool is positioned with the abutment end in the reference position the hanger holder is automatically positioned a builder unit from the reference position.

2. The construction tool of claim 1 including a second hanger holder carried by said elongated member, said second hanger holder spaced from the first hanger holder a distance equal to a builders unit.

3. The construction tool of claim 1 wherein the rigid elongated member comprises a right angle member.

4. The construction tool of claim 1 wherein the rigid elongated members includes fasteners for temporarily securing the elongated member to a member.

5. The construction tool of claim 1 wherein the construction tool is metal having a first element positioned at a right angle to a second element with both the first element and second element including regions for temporarily securing the construction tool to a member.

6. The construction tool of claim 1 wherein the construction tool includes a first element and a second element with the first element and the second element includes a plurality of spaced apart holes for insertion of a fastening member therethrough to hold the construction tool in position.

7. The construction tool of claim 1 wherein the hanger holder is a notch and a hanger for temporarily insertion in the notch has a first width and the notch has a second width with said second width sufficiently small so as to from a frictional fit between the notch and the hanger.

8. A method of securing joist hangers comprising;

positioning a joist hanger in a hanger holder in a construction tool having a reference end with the reference end located a builders unit from the hanger holder;

temporarily securing the construction tool with the joist hanger to a member;

securing the joist hanger to the member; and removing the construction tool to leave the joist hanger secured to the member.

9. The method of claim 8 wherein the step of positioning a joist hanger in a hanger holder comprises the step of frictionally securing the joist hanger to a notch in the construction tool.

10. The method of claim 9 including the step of securing a second joist hanger to the member.

11. The method of claim 8 including the step of temporarily securing the construction tool comprises screw fastening the construction tool to the member.

12. The method of claim 8 wherein the step of temporarily securing the construction tool to a member comprises inserting a headless nail through an opening in an element of the construction tool.

13. A method of stud layout comprising:

placing a construction tool having a reference end and a plurality of reference notches each located a builders unit from each other on a member;

holding the construction tool in position by a hand of a user; marking the position of the reference notches on the member with a visual marker; and removing the construction tool to provide visual markings spaced a builders unit from each other.

14. The method of claim 13 including repositioning the construction tool by placing the reference end in abutment with a marking on the member and marking a new position of the reference notch on the member.

15. A multiple use construction tool comprising:

a rigid elongated member, said rigid elongated member having an abutment end for locating the construction tool with respect to a reference position, a hanger holder comprising a notch in an element of the elongated member for temporarily securing a hanger thereto, said notch spaced from the abutment end so that when the construction tool is positioned with the abutment end in the reference position the notch temporarily secured to the construction tool is positioned a builder unit from the reference position.

* * * * *